US008998115B2

(12) United States Patent
Salcedo et al.

(10) Patent No.: US 8,998,115 B2
(45) Date of Patent: Apr. 7, 2015

(54) INJECTION VALVE COMPRISING A TRANSMISSION UNIT

(75) Inventors: Sven Jaime Salcedo, Ebersberg (DE); Michael Knoller, Regensburg (DE)

(73) Assignee: Continental Automotive GmbH, Hanover (DE)

( * ) Notice: Subject to any disclaimer, the term of this patent is extended or adjusted under 35 U.S.C. 154(b) by 479 days.

(21) Appl. No.: 13/377,197

(22) PCT Filed: Jun. 10, 2010

(86) PCT No.: PCT/EP2010/058132

§ 371 (c)(1), (2), (4) Date: Mar. 5, 2012

(87) PCT Pub. No.: WO2010/142753

PCT Pub. Date: Dec. 16, 2010

(65) Prior Publication Data

US 2012/0160210 A1 Jun. 28, 2012

(30) Foreign Application Priority Data

Jun. 10, 2009 (DE) ..... 10 2009 024 595

(51) Int. Cl.
*B05B 1/30* (2006.01)
*F02M 51/00* (2006.01)
(Continued)

(52) U.S. Cl.
CPC ..... *F02M 51/0603* (2013.01); *F02M 61/168* (2013.01); *F02M 2200/702* (2013.01)

(58) Field of Classification Search
CPC ..... F02M 47/00; F02M 47/027; F02M 51/00; F02M 51/06; F02B 19/00; F02B 23/00
USPC ..... 123/294, 467; 239/88, 96, 584–585.5, 239/102.1–102.2
See application file for complete search history.

(56) References Cited

U.S. PATENT DOCUMENTS 5,033,442 A 7/1991 Perr et al. ..... 123/502
6,298,829 B1 10/2001 Welch et al. ..... 123/467
(Continued)

FOREIGN PATENT DOCUMENTS

DE 19950760 A1 10/1999 ..... F02M 51/06
DE 10326914 A1 1/2005 ..... F02M 51/06
(Continued)

OTHER PUBLICATIONS

International PCT Search Report and Written Opinion, PCT/EP2010/058132, 15 pages, Aug. 4, 2010.
(Continued)

*Primary Examiner* — Thomas Moulis
*Assistant Examiner* — Joseph Dallo
(74) *Attorney, Agent, or Firm* — King & Spalding L.L.P.

(57) ABSTRACT

An injection valve for injecting fuel into an internal combustion engine may include an actuator, an injection needle associated with a sealing seat, and a transmission unit that establishes an effective connection between the actuator and the injection needle. The transmission unit may include a pressure chamber including two movable pistons that are guided within a movable pot. The first piston may be guided through a bottom of the pot while maintaining a first sealing gap, and the second piston may be guided within a sleeve section of the pot while maintaining a second sealing gap. One piston may be effectively connected to the injection needle, while the other piston may be effectively connected to the actuator.

21 Claims, 4 Drawing Sheets

(51) Int. Cl.
*F02M 51/06* (2006.01)
*F02M 61/16* (2006.01)

(56) References Cited

U.S. PATENT DOCUMENTS

| | | | | |
|---|---|---|---|---|
| 6,390,385 | B1 | 5/2002 | Hardy et al. | 239/102.2 |
| 6,575,138 | B2 | 6/2003 | Welch et al. | 123/467 |
| 6,679,440 | B2 | 1/2004 | Igashira et al. | 239/533.2 |
| 6,685,105 | B1 | 2/2004 | Ruehle et al. | 239/102.1 |
| 6,749,126 | B1 * | 6/2004 | Ruehle | 239/4 |
| 7,290,530 | B2 | 11/2007 | Boecking | 123/467 |
| 7,419,103 | B2 | 9/2008 | Pauer | 239/88 |
| 7,484,673 | B2 | 2/2009 | Boecking | 239/88 |
| 7,644,874 | B2 | 1/2010 | Mochizuki et al. | 239/96 |
| 7,673,811 | B2 | 3/2010 | Schuster et al. | 239/102.2 |
| 7,699,242 | B2 | 4/2010 | Mochizuki et al. | 239/102.2 |
| 7,770,823 | B2 | 8/2010 | Kubota et al. | 239/533.14 |
| 8,418,941 | B2 | 4/2013 | Melzer et al. | 239/533.9 |
| 8,766,875 | B2 | 7/2014 | Williams et al. | 343/912 |
| 2006/0012265 | A1 * | 1/2006 | Bachmaier et al. | 310/316.01 |
| 2006/0016916 | A1 * | 1/2006 | Petrone et al. | 239/533.2 |
| 2006/0151637 | A1 * | 7/2006 | Schneider et al. | 239/533.2 |
| 2006/0175436 | A1 | 8/2006 | Boecking | 239/533.2 |
| 2007/0023542 | A1 * | 2/2007 | Stoecklein | 239/88 |
| 2007/0152080 | A1 * | 7/2007 | Boecking | 239/102.2 |
| 2008/0093482 | A1 | 4/2008 | Boecking | 239/585.5 |
| 2008/0217440 | A1 | 9/2008 | Mochizuki et al. | 239/585.5 |
| 2008/0217441 | A1 | 9/2008 | Mochizuki et al. | 239/585.5 |
| 2008/0296414 | A1 | 12/2008 | Kubota et al. | 239/533.11 |
| 2009/0200406 | A1 * | 8/2009 | Kronberger | 239/585.5 |
| 2009/0266921 | A1 | 10/2009 | Boecking | 239/585.5 |

FOREIGN PATENT DOCUMENTS

| | | | | |
|---|---|---|---|---|
| DE | 10353045 | A1 | 6/2005 | F02M 51/06 |
| DE | 102004035313 | A1 | 2/2006 | F02M 47/00 |
| DE | 102005004738 | A1 | 8/2006 | F02M 51/06 |
| DE | 102005015731 | A1 | 10/2006 | F02M 51/06 |
| DE | 102005042786 | A1 | 3/2007 | F02M 51/06 |
| DE | 102006027327 | A1 | 12/2007 | F02M 51/06 |
| DE | 102007003216 | A1 | 7/2008 | F02M 51/06 |
| DE | 102008000985 | A1 | 10/2008 | F02M 51/06 |
| WO | 2005/010341 | A1 | 2/2005 | F02M 47/02 |
| WO | 2008/003347 | A1 | 1/2008 | F02M 51/06 |

OTHER PUBLICATIONS

International PCT Search Report and Written Opinion, PCT/EP2010/058158, 14 pages, Jul. 14, 2010.

U.S. Non-Final Office Action, U.S. Appl. No. 13/377,240, 19 pages, Sep. 22, 2014.

* cited by examiner

INJECTION VALVE COMPRISING A TRANSMISSION UNIT

CROSS-REFERENCE TO RELATED APPLICATIONS

This application is a U.S. National Stage Application of International Application No. PCT/EP2010/058132 filed Jun. 10, 2010, which designates the United States of America, and claims priority to German Application No. 10 2009 024 595.2 filed Jun. 10, 2009, the contents of which are hereby incorporated by reference in their entirety.

TECHNICAL FIELD

The invention relates to an injection valve comprising a transmission unit.

BACKGROUND

Existing disclosures, for example, WO 2008/003347 A1, U.S. Pat. No. 6,575,138 B2 and U.S. Pat. No. 6,298,829, disclose injection valves in which a hydraulic transmission unit is provided between an actuator and the nozzle needle.

In some existing disclosures, the deflection of the actuator is transmitted into a corresponding deflection of the nozzle needle.

SUMMARY

In one embodiment, an injection valve for injecting fuel into an internal combustion engine includes an actuator, a nozzle needle associated with a sealing seat, and a transmission unit that establishes an effective connection between the actuator and the nozzle needle. The transmission unit has a pressure chamber bounded by two movable pistons which are guided in a movable pot, wherein the first piston is guided through a bottom of the pot with a first sealing gap, wherein the second piston is guided in a sleeve-shaped section of the pot with a second sealing gap, and wherein one piston is operatively connected to the nozzle needle and the other piston is operatively connected to the actuator.

In a further embodiment, the first piston bounds the pressure chamber with a larger end face than an annular face, adjoining the first piston, of the pot. In a further embodiment, a spring element is arranged in the pressure chamber and is inserted between the second piston and the bottom of the pot. In a further embodiment, the second piston has a sleeve-shaped pot shape, wherein an end of the nozzle needle projects into the sleeve-shaped section of the second piston, wherein the nozzle needle is attached in a positively locking fashion to the pot via a connecting part. In a further embodiment, the connecting part is embodied in the form of a partial ring plate which is open on one side and which comprises in a positively locking fashion a notch of the nozzle needle in a central region and is connected to the pot in an external region. In a further embodiment, the sleeve-shaped section of the second piston has free-standing wall sections in a lower end region, wherein the wall sections are guided through the cutouts and rest on a stop face. In a further embodiment, the connecting part has a partial-ring-shaped web whose external diameter corresponds substantially to the internal diameter of the sleeve-shaped section of the pot, and wherein the sleeve-shaped section of the pot is plugged over the web.

BRIEF DESCRIPTION OF THE DRAWINGS

Example embodiments will be explained in more detail below with reference to figures, in which.

DETAILED DESCRIPTION

Figure 1:
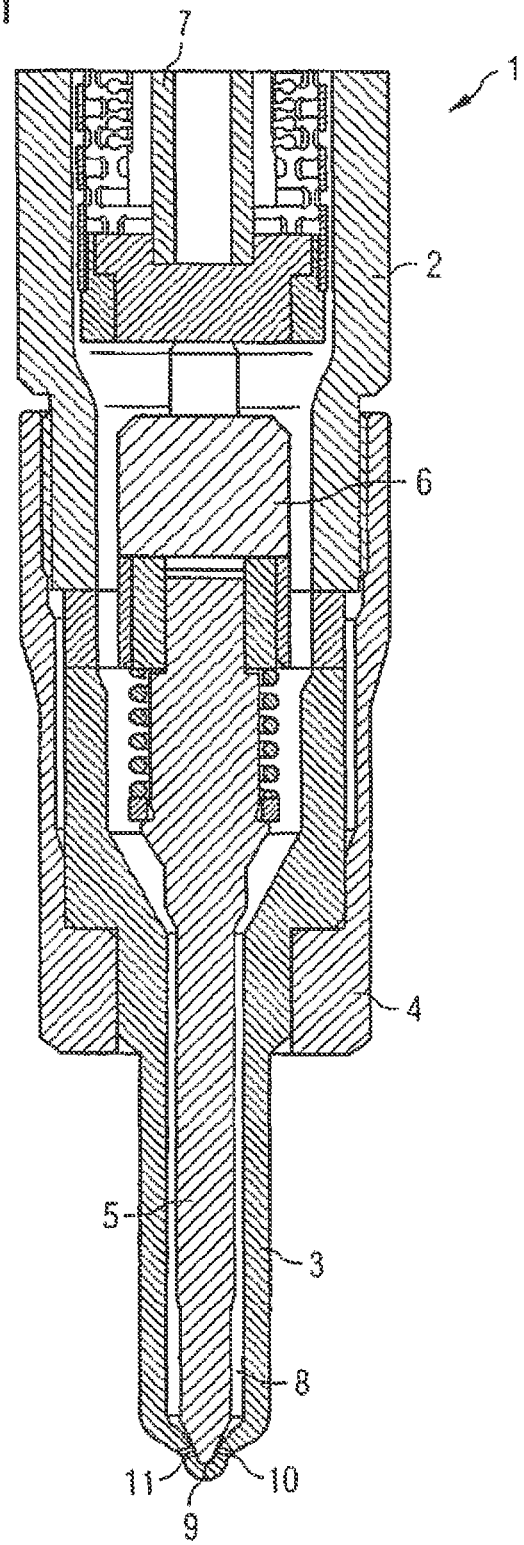
FIG. 1 shows a schematic design of an example injection valve, according to certain embodiments.

Certain embodiments of the present disclosure provide an improved transmission unit for an injection valve.

In some embodiments, the transmission unit has a pressure chamber which is bounded by two movable pistons, wherein the movable pistons are guided in a movable pot. A first piston is guided through a bottom of the pot with a first sealing gap. The second piston is guided in a sleeve section of the pot with a second sealing gap. One of the pistons is operatively connected to the nozzle needle and the other piston is operatively connected to the actuator. On the basis of this embodiment, a robust transmission unit is made available which, for a brief activation, transmits the deflection of the actuator directly into a deflection of the nozzle needle and additionally permits, via the sealing gaps, a chronologically slow change in the volume of the pressure chamber.

In one embodiment, the second piston is bound to the sealing chamber with a larger end face and an annular face of the bottom of the pot through which the first piston is guided. In this way, the deflection of the actuator is transmitted into a relatively large deflection of the nozzle needle. In this way, for example small deflections of a piezoelectric actuator can be converted into a sufficiently large deflection of the nozzle needle.

In a further embodiment, a spring element is arranged in the sealing chamber, wherein the spring element is clamped in between the second piston and the bottom of the pot. In this way it is ensured that the second piston is in abutment with a stop of the injection valve and the pressure chamber has a maximum volume. The operative connection between the actuator and the nozzle needle is thereby defined precisely.

In a further embodiment, the second piston has a sleeve-shaped pot shape, wherein an end of the nozzle needle projects into the sleeve-shaped section of the second piston. The nozzle needle is connected in a positively locking fashion to the pot via a connecting part. This permits simple attachment of the nozzle needle to the pot, wherein the installation space is also reduced.

In a further embodiment, the connecting element is embodied in the form of a partial ring plate which is open on one side and comprises a notch of the nozzle needle in a central region and is connected to the pot in an external region, in particular welded thereto. In this way, simple and reliable attachment of the nozzle needle to the pot is made possible.

In a further embodiment, the ring element has cutouts, wherein the sleeve-shaped section of the second piston has free-standing wall sections in a lower end region, wherein the wall sections are guided through the cutouts and rest on a stop face. Owing to this embodiment, reliable support of the second piston on the stop face is possible, and in addition an operative connection between the nozzle needle and the pot is made available with little installation space.

In a further embodiment, the connecting part has a partial-ring-shaped web whose external diameter corresponds substantially to the internal diameter of the sleeve-shaped pot, wherein the sleeve-shaped wall of the pot is plugged onto the web and surrounds the web. This permits additional securement of the connecting part to the pot. In this way, the connection between the connecting part and the pot becomes less sensitive to mechanical influences.

FIG. 1 shows, in a schematic illustration, an example injection valve 1 according to certain embodiments, which injection valve 1 has a housing 2 to whose lower end a nozzle body 3 is attached using a clamping nut 4. A nozzle needle 5 may be mounted so as to be movable in the longitudinal direction in the nozzle body 3. The nozzle needle 5 may be operatively connected to an actuator 7 via a transmission unit 6. In the lower region of the nozzle body 2, a fuel space 8 may be formed between the nozzle needle 5 and the nozzle body 3, which fuel space 8 may be supplied with fuel via ducts (not illustrated), for example by means of a fuel accumulator and/or by means of a fuel pump. An annular sealing seat 10 may be formed on the inner side of the nozzle body 3 between the fuel space 8 and injection holes 9. A sealing face 11 which runs around in an annular shape at the lower end of the nozzle needle 5 may be assigned to the sealing seat 10. Depending on the position of the nozzle needle, which is set by the actuation of the actuator 7, the nozzle needle 5 may lift off from the sealing seat 10 and clears a hydraulic connection between the fuel space 8 and the injection holes 9.

The actuator 7 can be embodied, for example, as a piezoelectric actuator or as a magnetic actuator. As a result of electrical energization of the actuator 7, the actuator 7 may become longer and may therefore act on the transmission unit 6. The transmission unit 6 may be embodied in such a way that the deflection of the actuator 7 is transmitted to the nozzle needle 5. The deflection of the actuator 7 in the direction of the nozzle needle 5 may be advantageously converted into an opposing movement of the nozzle needle 5 in the direction of the actuator 7 using the transmission unit 6.

Figure 2:
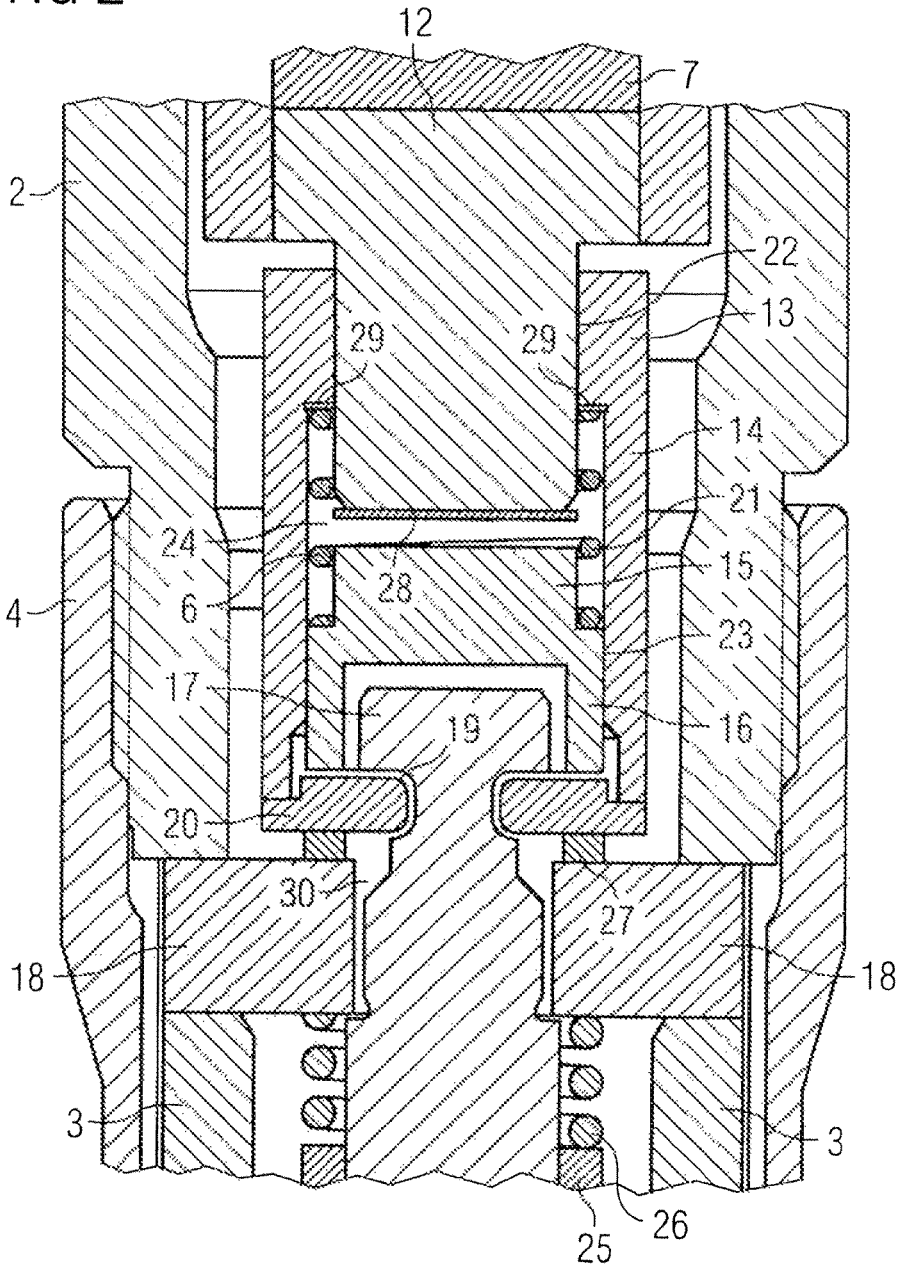
FIG. 2 shows a schematic design of an example transmission unit of the injection valve of FIG. 1, according to certain embodiments.

FIG. 2 shows an example embodiment of a transmission unit 6 which is arranged between the actuator 7 and the nozzle needle 5 in the housing 2. The transmission unit 6 has a first piston 12 which projects through a bottom 13 of a sleeve-shaped pot 14. The pot 14 may be movably mounted. The first piston 12 may be fixedly connected to the actuator 7. Furthermore, a second piston 15 may be provided which projects from an underside into the sleeve-shaped section of the pot 14. The second piston 15 may be also of sleeve-shaped design, wherein an end piece 17 of the nozzle needle 5 may project into a sleeve-shaped section 16 of the second piston 15. The end piece 17 may be guided through a hole 30 of a stop plate 18, which is fixedly clamped to the housing 2. The end piece may have a notch 19 into which a connecting part 20 engages. The connecting part 20 may be additionally connected to the sleeve 14, in particular welded, caulked or bonded thereto.

The second piston 15 may be seated with lower edge faces 27 on an upper side of the stop plate 18. The upper side of the stop plate 18 may constitute a stop face for the second piston 15.

The first piston 12 may bound a pressure chamber 24 with an end face 28. The pot 14 may bound the pressure chamber 24 with an annular face 29, wherein the annular face 29 may be formed on the inner side of the bottom 13, adjacent to the first piston 12.

A spring element 21 may be clamped in between an inner side of the bottom 13 and a step on the second piston 14. The first piston 12 may be guided through the bottom 13 via a first sealing gap 22. The first sealing gap 22 may be of a magnitude in the range from 3 to 15 μm, in particular in the region of 8 μm. The second piston 15 may be spaced apart from the inner wall of the sleeve 14 by means of a second sealing gap 23. The second sealing gap 23 may be of a magnitude from 3 to 15 μm, in particular in the range of 8 μm. The first piston 12, the sleeve 14 and the second piston 15 bound the pressure chamber 24. The pressure chamber 24 may be filled with fuel and is connected via the sealing gaps 22, 23 to the interior of the housing 2, which is also filled with fuel. Fuel with a low pressure may be arranged between the housing 2 and the transmission unit 6. A second spring element 26 may be clamped in between an underside of the stop plate 18 and a second step 25 on the nozzle needle 5. The second spring element 26 may prestress the nozzle needle 5 in the direction of the sealing seat 10. The second spring element 26 may have a larger spring force than the spring element 21. The annular face 29 may be advantageously smaller than the end face 28. In particular, the annular face 29 may be half as large as the end face 28. The surface area ratio between the annular face 29 and the end face 28 may define a transmission ratio between the deflection of the actuator and of the nozzle needle and can be correspondingly selected.

In some embodiments, the transmission unit 6 according to FIG. 2 may function as follows: in the non-actuated state of the actuator 7, the nozzle needle 5 is pressed, with the sealing face 11, onto the sealing seat 10 owing to the second spring element 26. As a result, no fuel can be put out of the fuel space 8 via the injection holes 9. The pressure chamber 24 is filled with fuel. In this context, the first and second pistons 12, 15 have spacing. The second piston 15 is supported on the stop plate 18 with the edge face 27. The first and second sealing gaps 22, 23 are so narrowly dimensioned that when there is a brief application of pressure, which takes place within the scope of an injection by the actuator 7, no change in the volume of the pressure chamber takes place. The first and second sealing gaps ensure that the pressure chamber 24 is always filled with fuel.

If the actuator 7 is then deflected, for example by energization, the actuator 7 presses the first piston 12 downward in the direction of the nozzle needle 5, since the actuator 7 is supported in the upper region against the housing 2. As a result of this, the end face 28 forces fuel in the pressure chamber 24, as a result of which the increased fuel pressure acts on the annular face 29, and the pot 14 moves upward counter to the direction of movement of the first piston 12. The pot 14 is connected via the connecting part 20 to the nozzle needle 5, with the result that the nozzle needle 5 is lifted off from the assigned sealing seat 10 by the movement of the pot 14. As a result, fuel can be injected via the injection holes 9. In this context, the second spring element 26 is compressed. In addition, the spring element 21 is deflected since the distance between the step on the second piston 15 and the annular face 29 increases. As stated above, the volume of the pressure chamber 24 is substantially constant during this process.

In order to end the injection, the increase in length of the actuator 7 is shortened, with the result that the first piston 12 is moved upward out of the pressure chamber 24, the pressure in the pressure chamber 24 decreases. Consequently, the pot 14 is moved downward in the direction of the stop plate 18, with the result that the nozzle needle 5 moves again into abutment on the sealing seat 10 with the sealing face 11. The injection is therefore interrupted.

Figure 3:
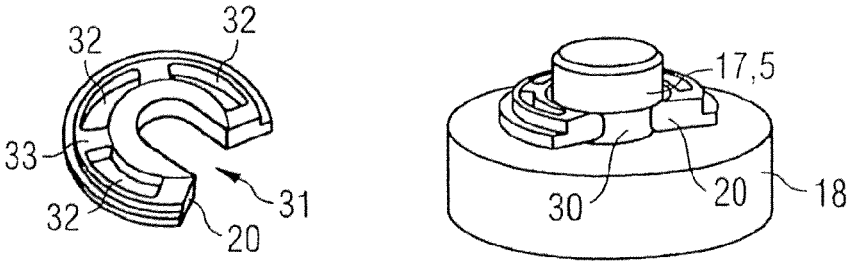
FIG. 3 shows an end of the nozzle needle with a connecting part, according to certain embodiments.

FIG. 3 shows a partial illustration of the nozzle needle 5 and the stop plate 18 through whose central hole 30 the end piece 17 of the nozzle needle 5 projects. The end piece 17 may have an annular notch 19 into which the connecting part 20 is inserted laterally. The connecting part 20 is illustrated on the left next to the stop plate 18 in a perspective illustration. The connecting part 20 may be embodied as a plate-shaped part which is in the shape of a pitch circle. An insertion opening 31 may be formed in the connecting part 20 and extends as far as the center of the pitch-circle-shaped connecting part 20. The diameter of the insertion opening 31 may correspond substantially to the diameter of the nozzle needle 5 in the region of the notch 19. Furthermore, the connecting part 20 may have three cutouts 32. Furthermore, a web 33 which runs around a center point of the connecting part 20 in the form of a partial ring may be formed.

The pressure chamber 24 may be supplied with fuel via the sealing gaps 22, 23, said fuel being present in the housing of the injection valve. The pressure chamber 24 may therefore always be filled with fuel. The sealing gaps 22, 23 may be selected in such a way that the sealing gaps 22, 23 are sealed for chronologically short increases in pressure which occur during injection processes. Chronologically longer lasting pressure differences may lead to the flowing in or flowing out of fuel in or out of the pressure chamber via the sealing gaps, such that the volume of the pressure chamber can change.

Figure 4:
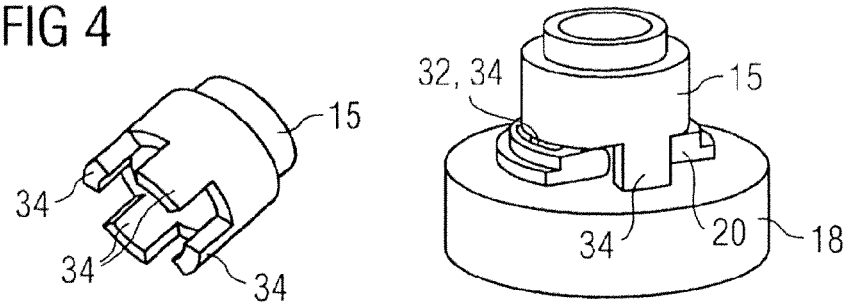
FIG. 4 shows an end of the nozzle needle with a mounted second piston, according to certain embodiments.
Figure 5:
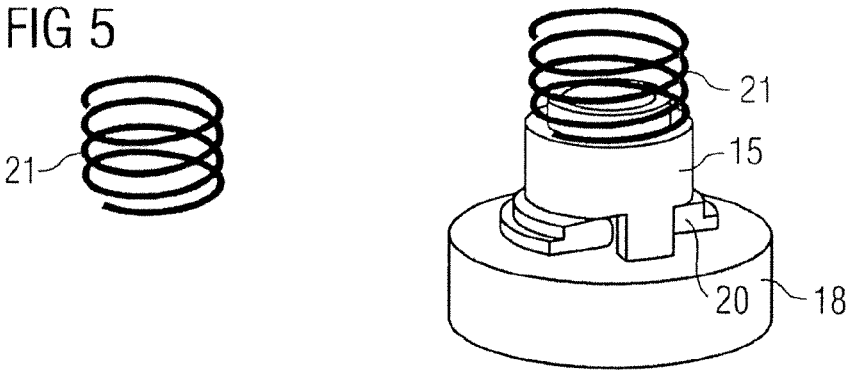
FIG. 5 shows an end of the nozzle needle with a second piston and a spring element, according to certain embodiments.
Figure 6:
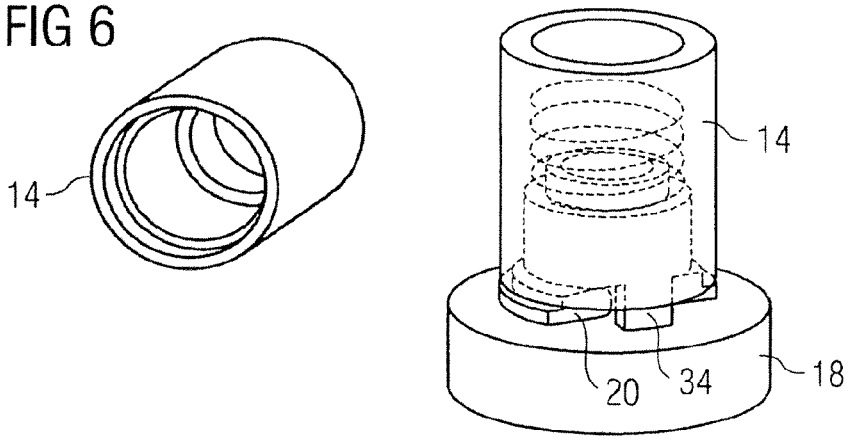
FIG. 6 shows an end of the nozzle needle with a mounted pot, according to certain embodiments.
Figure 7:
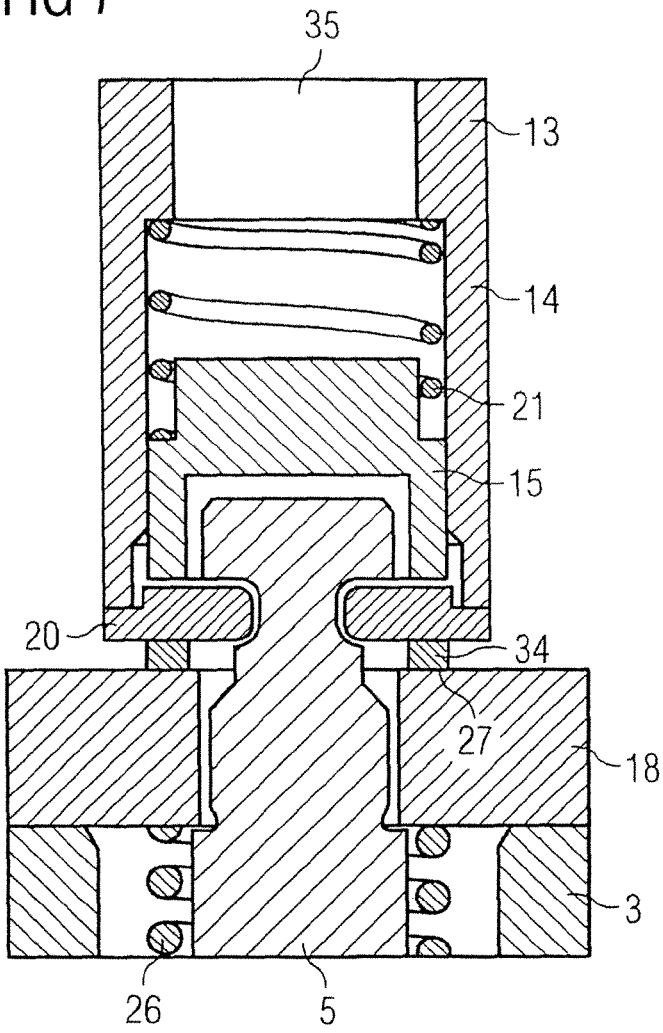
FIG. 7 shows a cross section through the end of the nozzle needle with a mounted pot.

For the purpose of mounting, the connecting part 20 may be inserted upward with the web 33 into the notch 19, as is illustrated in the right-hand region of FIG. 3. Then, in order to mount the injection valve the second piston 15 may be plugged onto the end piece 17 of the nozzle needle 5, wherein web-like wall sections 34 may project through the cutouts 32, and the wall sections 34 of the second piston 15 rest with edge faces 27 on the stop plate 18, as is illustrated in FIG. 4. The spring element 21 may then be plugged onto the stepped, upper region of the second piston 15, as is illustrated in FIG. 5. The sleeve 14 may then be fitted onto the second piston 15, as is illustrated in FIG. 6. The sleeve 14 may then be welded in the outer edge region to the connecting part 20, as is illustrated in cross section in FIG. 7. For further mounting, the first piston 12 may be plugged into an opening 35 in the bottom 13 of the sleeve 14, as is illustrated in FIG. 2.

What is claimed is:

1. An injection valve for injecting fuel into an internal combustion engine, comprising:

an actuator, a nozzle needle associated with a sealing seat, and a transmission unit that establishes an effective connection between the actuator and the nozzle needle, wherein the transmission unit includes a pressure chamber bounded by first and second movable pistons which are guided in a movable pot, wherein the first piston is operatively connected to the actuator and guided through a bottom of the pot with a first sealing gap, wherein the second piston is operatively connected to the nozzle needle and guided in a sleeve-shaped section of the pot with a second sealing gap, the nozzle needle is coupled to the sleeve-shaped section of the pot by a mechanical coupling such that movement of the sleeve-shaped section in a first direction away from the sealing seat physically lifts the nozzle needle, via the mechanical coupling, in the first direction away from the sealing seat, and wherein the actuator, first piston, second piston, and sleeve-shaped section of the pot are operatively connected such that actuation of the actuator forces the first piston in a second direction toward the sealing seat, which thereby acts on a fluid in the pressure chamber of the transmission unit in a manner that forces the sleeve-shaped section of the pot the first direction away from the sealing seat, to thereby lift the nozzle needle, via the mechanical coupling, from the sealing seat.

2. The injection valve of claim 1, wherein the first piston bounds the pressure chamber with a larger end face than an annular face, adjoining the first piston, of the pot.

3. The injection valve as claimed of claim 1, wherein a spring element is arranged in the pressure chamber and between the second piston and the bottom of the pot.

4. The injection valve of claim 1, wherein:

the second piston has a sleeve-shaped pot shape, an end of the nozzle needle projects into the sleeve-shaped section of the second piston, and the nozzle needle is locked to the pot via a connecting part to thereby define the mechanical coupling between the nozzle needle and the sleeve-shaped section of the pot.

5. The injection valve of claim 4, wherein the connecting part comprises a partial ring plate which is open on one side and which receives a notch of the nozzle needle in a central region and which is connected to the pot in an external region.

6. The injection valve of claim 4, wherein:

the connecting part has cutouts, the sleeve-shaped section of the second piston has wall sections in a lower end region, and the wall sections are guided through the cutouts.

7. The injection valve of claim 4, wherein:

the connecting part has a partial-ring-shaped web whose external diameter corresponds substantially to an internal diameter of the sleeve-shaped section of the pot, and the sleeve-shaped section of the pot is arranged over the web.

8. The injection valve of claim 1, wherein the pressure chamber is supplied fuel via at least one of the first sealing gap and the second sealing gap.

9. The injection valve of claim 1, wherein the pressure chamber is supplied fuel via the first sealing gap and the second sealing gap.

10. The injection valve of claim 1, wherein the first sealing gap and the second sealing gap are configured to provide a seal against temporally short pressure changes that occur during an injection process, but allow fuel to flow into or out of the pressure chamber via the sealing gaps during temporally longer pressure changes.

11. An injection valve for injecting fuel into an internal combustion engine, comprising:

an actuator, a nozzle needle associated with a sealing seat, and a transmission unit that establishes an effective connection between the actuator and the nozzle needle, a sleeve-shaped movable pot, wherein the transmission unit includes a pressure chamber bounded by first and second movable pistons which are guided in the sleeve-shaped movable pot, wherein a connecting part is fixed to one end of the sleeve-shaped movable pot to form a pot/connecting part assembly, wherein an end portion of the nozzle needle includes a notch that receives the connecting part such that the nozzle needle is secured to the pot/connecting part assembly by a mechanical coupling, such that movement of the sleeve-shaped section in a first direction away from the sealing seat physically lifts the nozzle needle, via the mechanical coupling, in the first direction away from the sealing seat, and wherein the actuator, first piston, second piston, and sleeve-shaped section of the pot are operatively connected such that actuation of the actuator forces the first piston in a first direction toward the sealing seat, which thereby acts on a fluid in the pressure chamber of the transmission unit in a manner that forces the sleeve-shaped section of the pot the first direction away from the sealing seat, to thereby lift the nozzle needle, via the mechanical coupling, from the sealing seat.

12. The injection valve of claim 11, wherein the first piston bounds the pressure chamber with a larger end face than an annular face, adjoining the first piston, of the pot.

13. The injection valve as claimed of claim 11, wherein a spring element is arranged in the pressure chamber and between the second piston and the bottom of the pot.

14. The injection valve of claim 11, wherein:

the second piston has a sleeve-shaped pot shape, and the end portion of nozzle needle projects into the sleeve-shaped section of the second piston.

15. The injection valve of claim 14, wherein the connecting part comprises a partial ring plate which is open on one side and which receives the notch of the nozzle needle in a central region and which is connected to the pot in an external region.

16. The injection valve of claim 14, wherein:

the connecting part has cutouts, the sleeve-shaped section of the second piston has wall sections in a lower end region, and the wall sections are guided through the cutouts.

17. The injection valve of claim 14, wherein:

the connecting part has a partial-ring-shaped web whose external diameter corresponds substantially to an internal diameter of the sleeve-shaped section of the pot, and the sleeve-shaped section of the pot is arranged over the web.

18. The injection valve of claim 11, wherein:

wherein the first piston is guided through a bottom of the pot with a first sealing gap, wherein the second piston is guided in a sleeve-shaped section of the pot with a second sealing gap, and the pressure chamber is supplied fuel via the first sealing gap and the second sealing gap.

19. The injection valve of claim 18, wherein the first sealing gap and the second sealing gap are configured to provide a seal against temporally short pressure changes that occur during an injection process, but allow fuel to flow into or out of the pressure chamber via the sealing gaps during temporally longer pressure changes.

20. An internal combustion engine comprising:

at least one cylinder, and at least one injection valve for injecting fuel into the at least one cylinder, each injection valve comprising:

an actuator, a nozzle needle associated with a sealing seat, and a transmission unit that establishes an effective connection between the actuator and the nozzle needle, wherein the transmission unit includes a pressure chamber bounded by first and second movable pistons which are guided in a movable pot, wherein the first piston is operatively connected to the actuator and guided through a bottom of the pot, wherein the second piston is operatively connected to the nozzle needle and guided in a sleeve-shaped section of the pot, wherein the nozzle needle is coupled to the sleeve-shaped section of the pot by a mechanical coupling such that movement of the sleeve-shaped section in a first direction away from the sealing seat physically lifts the nozzle needle, via the mechanical coupling, in the first direction away from the sealing seat, and wherein the actuator, first piston, second piston, and sleeve-shaped section of the pot are operatively connected such that actuation of the actuator forces the first piston in a second direction toward the sealing seat, which thereby acts on a fluid in the pressure chamber of the transmission unit in a manner that forces the sleeve-shaped section of the pot the first direction away from the sealing seat, to thereby lift the nozzle needle, via the mechanical coupling, from the sealing seat.

21. The injection valve of claim 1, wherein the fluid in the pressure chamber comprises fuel.

* * * * *